United States Patent [19]

Kasuya et al.

[11] 4,401,420

[45] Aug. 30, 1983

[54] MALE AND FEMALE SCREW ROTOR ASSEMBLY WITH SPECIFIC TOOTH FLANKS

[75] Inventors: Katsuhiko Kasuya, Shimoinayoshi; Mitsuru Fujiwara, Dejimamura; Masaya Imai; Tetsuzo Matsunaga, both of Sakuramura; Yasuo Takahashi, Ayase, all of Japan

[73] Assignee: Hitachi, Ltd., Tokyo, Japan

[21] Appl. No.: 186,646

[22] Filed: Sep. 12, 1980

[30] Foreign Application Priority Data

Sep. 14, 1979 [JP] Japan ..... 54-117259

[51] Int. Cl.[3] ..... F01C 1/16; F16H 55/08; F04C 18/16

[52] U.S. Cl. ..... 418/201; 74/466

[58] Field of Search ..... 418/197, 201-203; 74/466

[56] References Cited

U.S. PATENT DOCUMENTS 2,473,234 6/1949 Whitfield ..... 418/201

3,773,444 11/1973 Koch ..... 418/201

3,787,154 1/1974 Edstrom ..... 418/201

FOREIGN PATENT DOCUMENTS 161228 8/1979 Netherlands ..... 418/201

*Primary Examiner*—John J. Vrablik

*Attorney, Agent, or Firm*—Antonelli, Terry & Wands

[57] ABSTRACT

An oil-cooled type screw rotor assembly having a female rotor and a male rotor adapted to rotate around parallel axes in meshing relation to each other. The leading side flank of the female rotor is constituted by a first leading side flank formed by an arc of a radius $R_1$ and a second leading side flank formed by an arc of a radius $R_2$. Also, the trailing side flank of the female rotor is constituted by a first trailing side flank formed by an arc of the tooth ends of the male rotor having a radius $R_5$ and a second trailing side flank formed by an arc of a radius $R_3$ which is smaller than the radius $R_2$ of the second leading side flank. The configuration of the teeth of the male rotor is materially formed by arcs of the leading and trailing side flanks of the female rotor.

11 Claims, 7 Drawing Figures

MALE AND FEMALE SCREW ROTOR ASSEMBLY WITH SPECIFIC TOOTH FLANKS

BACKGROUND OF THE INVENTION

1. Field of the Invention

The present invention relates to a shape of a screw rotor for use in oil-cooled type screw compressor or expander and, more particularly, to a screw rotor having a shape suitable for hobbing.

2. Description of the Prior Art

Generally speaking, a screw rotor of asymmetric teeth type, used in screw compressors or the like, has a female rotor and a male rotor in a pair, the female rotor having its major part at the inside of the pitch circle, while the male rotor having its major part at the outside of the pitch circle.

FIG. 1 shows an example of the screw rotor of the kind described. A female rotor 1 and a male rotor 2 meshing with each other are adapted to rotate around respective axes 3, 4 within the casing (not shown) in the direction of arrows to function as a compressor. The female rotor 1 is provided with a multiplicity of grooves 5 and ridges 6. Each groove 5 has a leading side flank 7, a first trailing side flank 8, a second trailing side flank 9 and a teeth bottom flank 10 interconnecting the flanks 7 and 8. These flanks constitute a major part of the female rotor, the major part being disposed at the inside of a pitch circle 11. On the other hand, the male rotor 2 has a plurality of ridges 12 and grooves 13. Each ridge 12 has a major part constituted by a leading side flank 14, first trailing side flank 15, second trailing side flank 16 and a teeth end flank 17 interconnecting both flank 14 15. The major part constituted by these flanks is disposed at the outside of the pitch circle 18.

The portion between points 19 and 20 of the leading side flank 7 of the female rotor 1 has an arcuate form centered at a point 22 which is located on the extension of a line interconnecting the point 20 and the point of intersection of the pitch circles 11, 18, i.e. the pitch point 21, and is positioned such that the line interconnecting the points 19 and 22 is normal to the radial line at the point 19. The portion between points 23 and 24 of the first trailing side flank 8 is formed by a curve which is created by the junction point 25 between the first trailing side flank 15 and the teeth end flank 17 of the male rotor 2. The portion between points 24 and 26 on the second trailing side flank 9 is formed by the extension of a line interconnecting the center 3 of rotation and the point 24.

Referring now to the male rotor 2, the portion between points 27 and 28 of the leading side flank 14 is a curve created by the curve between the points 19 and 20 of the leading side flank of the female rotor 1. The portion between points 25 and 29 of the first trailing side flank 15 is a curve created by the point 24 of the female rotor 1. The portion between points 29 and 30 of the second trailing side flank 16 is a curve created by the portion between points 24 and 26 of the female rotor 1. Finally, the portion between points 28 and 25 of the teeth end flank 17 is an arc centered at the pitch point 21.

At the outside of the pitch circle 11 of the ridge 6 of the female rotor 1, are disposed the follow portion between points 19 and 31 and follow portion between points 26 and 32. These points 31, 32 are positioned at the top of respective ridges.

Similarly, at the inside of the pitch circle 18 of the groove 13 of male rotor 2, are disposed a follow portion between points 27 and 33 and a follow portion between points 30 and 34. The points 33 and 34 are positioned on the bottom of groove 13.

The screw rotor having the described shape is not suitable for hobbing.

Namely, a pressure angle is zero at each of the points 19, 26, 27, 30 located on the pitch circles 11, 18 of both rotors 1, 2, so that a generating pitch circle is set at the outside of the pitch circle of the rotor. If this generating pitch circle is made excessively large as compared with the pitch circle of the rotor, the minimum pressure angle on the hobbing edge is increased to advantageously prolong the life of the tool. This, however, on the other hand causes a large polygonal error, resulting in a deteriorated error of shape of the rotor. Therefore, the setting of the generating pitch circle is limited by both of the tool life and the precision of the rotor. In addition, in the cutting of this rotor, it is not possible to preserve a sufficiently large radius of curvature of the hobbing edge for male rotor, which shares the greatest cutting amount, so that the tool is rapidly worn out locally at this position. Furthermore, since the hobbing cutter edge has a small minimum pressure angle for its teeth height, it is difficult to machine the hobbing edge at a sufficiently high precision, resulting in a raised cost of the hob.

The conventional screw rotor also has the following disadvantage also in the aspect of performance.

Generally, the performance of a screw compressor incorporating screw rotors is influenced by various factors. As to the shape of the rotor, these factors are the length of the seal line and the area of the blow hole.

The length of the seal line is the contact length between the teeth of rotors, and the product of this contact length and the gap between rotors is the area of leakage. FIG. 2 shows the projection of the locus of contact point of screw rotors shown in FIG. 1, on a cross-section perpendicular to the axis.

Referring to FIG. 2, the locus of contact point between the follow portions of the leading sides of the rotors 1, 2 is shown at curve a-b-c. Similarly, the locus of contact points between follow portions of the trailing side is shown at curve a-d-c. The locus of contact point between the leading side flanks is shown at curve a-e. The locus of contact point between the teeth bottom flank of the female rotor 1 and the teeth end flank of the male rotor 2 is shown at a curve e-f. The locus of contact point between the first trailing side flanks is shown at a curve f-g and a curve g-h. The locus of contact point between the second trailing side flanks is shown at curve h-a. These screw rotors have large lengths of sealing lines at the locus of contact point a-b-c, a-d-c and a-e. The large length of the seal line between rotors causes a correspondingly increased area of leakage, resulting in a deteriorated performance of the compressor.

In FIG. 2, the blow hole formed between the edge point i of the high-pressure casing and the point g on the above-mentioned locus is large because the distance between the points i and g are large due to the fact that the portion between points 24 and 26 of the second trailing side flank 9 of the female rotor 1 is formed by a straight line and due to the pressure of the follow portions between points 26 and 32. The large blow hole has a tendency to permit the leakage of the fluid from the high-pressure chamber to the low-pressure chamber to deteriorate the performance of the compressor.

A screw rotor for overcoming the above-described problem is disclosed, for example, in the specification of U.S. Pat. No. 3,787,154. This screw rotor, however, cannot provide a satisfactory solution to the problem of the tool life, blow hole area and so forth.

SUMMARY OF THE INVENTION

It is, therefore, an object of the invention to provide a screw rotor in which the blow hole area, as well as the seal line length, is reduced to ensure a higher performance.

It is another object of the invention to provide a screw rotor at a high precision and low cost, by making it possible to facilitate the high-precision machining of the hobbing tool edge and by improving the life of the hobbing tool.

To these ends, according to the invention, there is provided an oil cooled type screw rotor assembly having a female rotor and a male rotor rotatable around respective axes in meshing condition, with a leading side flank of the female rotor being constituted by a first leading side flank formed by an arc of a radius $R_1$ and centered at a point outside a pitch circle of the female rotor, a second leading side flank formed by an arc of a radius $R_2$ and centered at a point within the pitch circle, and a trailing side flank of the female rotor constituted by a first trailing side flank created by the outer teeth end of the male rotor of a radius $R_5$ and centered at a point located on the line interconnecting the axes of rotation of the rotors, a second trailing side flank is formed by an arc of a radius $R_3$ smaller than that $R_2$ of the second leading side flank and centered at a point within the pitch circle, while a profile of teeth of the male rotor is materially defined by the arcs of the leading and trailing side flanks of the female rotor.

BRIEF DESCRIPTION OF THE DRAWINGS

FIG. 5 is a schematic view illustrating a blow hole and locus of contact point in the screw rotor assembly of the invention; and .

Figure 1:
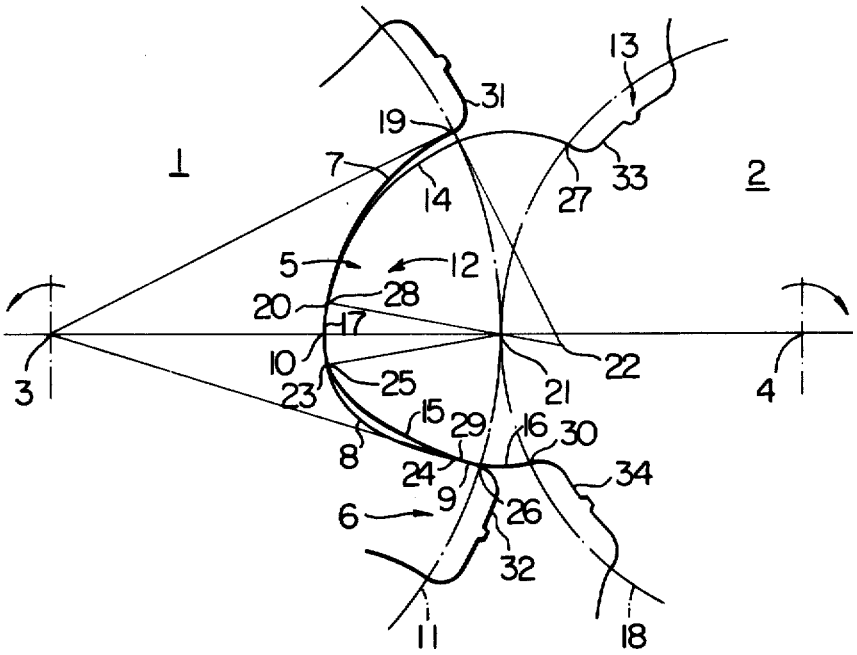
FIG. 1 PRIOR ART
FIG. 1 is a side view, on an enlarged scale, of portions of rotors of a conventional screw rotor assembly taken at a plane normal to the axes of the rotors.
Figure 2:
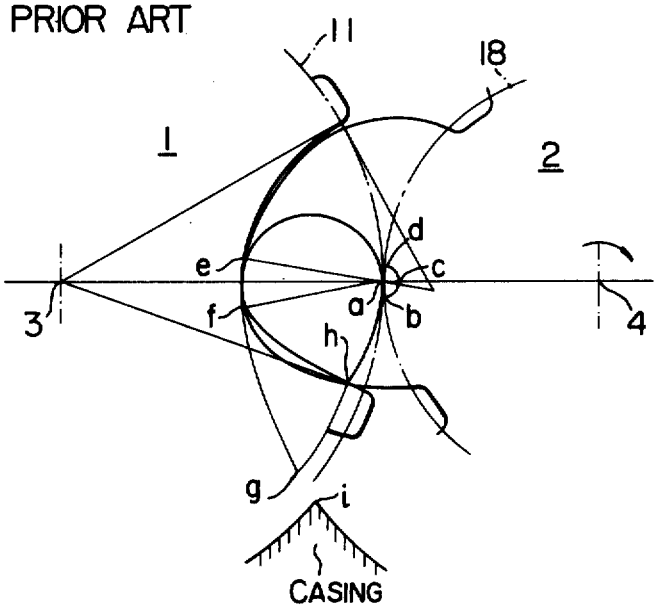
FIG. 2 PRIOR ART
FIG. 2 is a schematic view illustrating a blow hole and locus of contact point in conventional screw rotor assembly.
Figure 3:
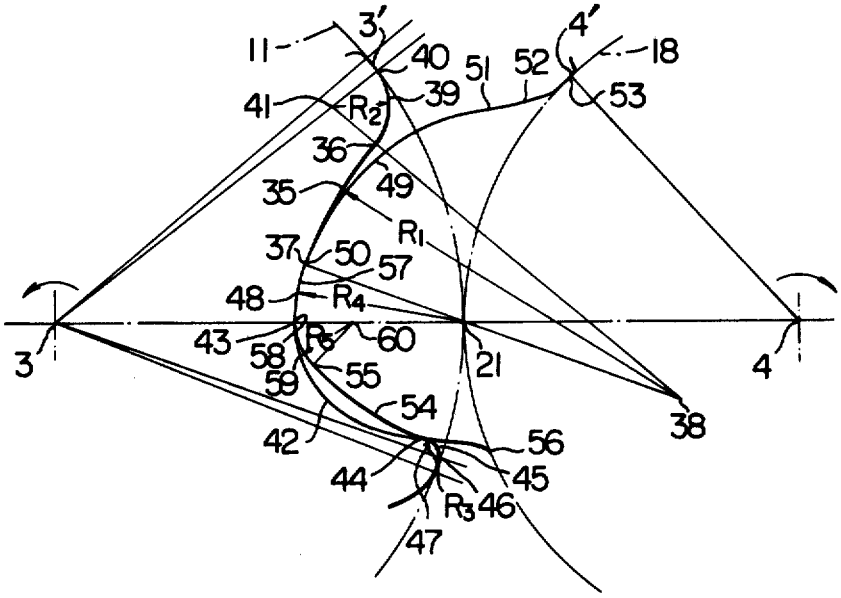
FIG. 3 is a schematic side view of a screw rotor assembly in accordance with an embodiment of the invention, taken at the plane normal to the axes of rotors.

Referring now to the drawings wherein like reference numerals are used throughout the various views to designate like parts and, more particularly, to FIG. 3, the female rotor 1 is devoid of the follow portions outside the pitch circle 11 and, hence, is constituted solely by the major portion disposed at the inside of the pitch circle 11. Similarly, the male rotor 2 is devoid of the follow portions inside the pitch circle 18 and, hence, is constituted solely by the major portion disposed at the outside of the pitch circle 18. The female rotor 1 and the male rotor 2 have five and six teeth, respectively. The female rotor 1 is adapted to be driven by the male rotor 2.

Referring first to the female rotor 1, the female rotor 1 has a first leading side flank 35 between points 36 and 37 formed by an arc of a radius $R_1$ and centered at a point 38 on the extension of a line interconnecting the point 37 and the point 21 of intersection of the pitch circles 13, 18. The radius $R_1$ is selected to be 1.3 to 2.5 times as large as the radius $R_4$ forming the later described leading side teeth bottom flank 48. The lower limit of this angle is determined by the pressure angle of the hob and the ratio of slip of the leading side flank 35 of the female rotor 1, while the upper limit is determined by the wall thickness of the second leading side flank 39 and the second trailing side flank of the female rotor 1 in view of the mechanical strength.

By selecting a large radius $R_1$ of the arc of the first leading side flank 35 as compared with the conventional screw rotor, it is possible to preserve a large pressure angle of the hobbing edge of the tool so that the fabrication of the hobbing tool is very much facilitated. In consequence, it is possible to form a hobbing tool having a precisely finished edge shape at a low cost. At the same time, since the slip ratio at the portion between points 36 and 37 on the first leading side flank 35 of the female rotor 1, through which the power is transmitted from the male rotor 2 to the female rotor 1 to drive the latter, is advantageously reduced to remarkably reduce the wear of both rotors while achieving a reduction of mechanical loss.

Figure 4:
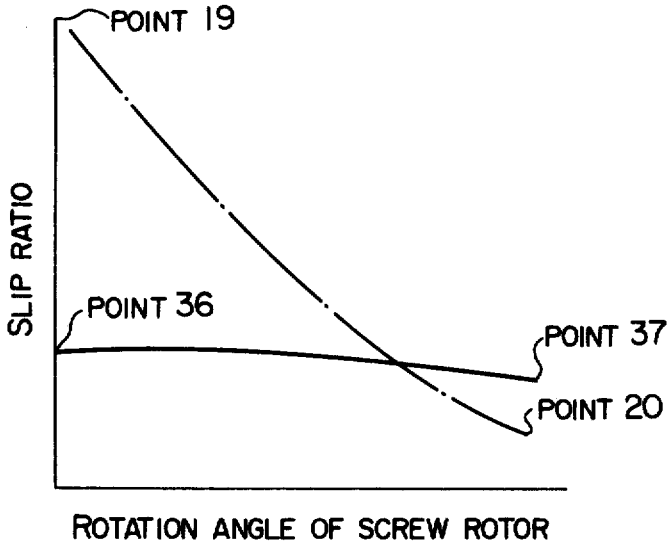
FIG. 4 is a graph showing a relationship between a slip ratio and rotation angle in the screw rotor assembly of the invention.

Namely, the slip ratio at the first leading side flank 35 is reduced as shown by full line in FIG. 4, because of the increased radius $R_1$ and, in addition, not so much changed by the shifting of the rotation angle. In contrast, in the conventional screw rotor assembly, the slip ratio is impractically large as shown by the one-dot chain line, and is changed by the shifting of the rotation angle.

Referring again to FIG. 3, the second leading side flank 39 of the female rotor 1, is connected to the first leading side flank 35. This second leading side flank 39 extends over the points 36 and 40 which are located on an arc of a radius $R_2$ and centered at a point 41 on the extension of a line connecting the points 38 and 36 at the inside of the pitch circle 11. The arc of the radius $R_2$ is greater than the arc formed at the end of the teeth of the trailing side flank which will be discussed later. By selecting a large radius $R_2$ of the arc forming the second leading side flank 39, it is possible to remarkably improve the life of the edge of the hobbing tool.

At the same time, the length of the contact locus of the leading side flank is very much reduced as compared with that of the conventional screw rotor assembly because the seal line formed by the follow portions is eliminated, so that the leak of the liquid is remarkably reduced.

Figure 5:
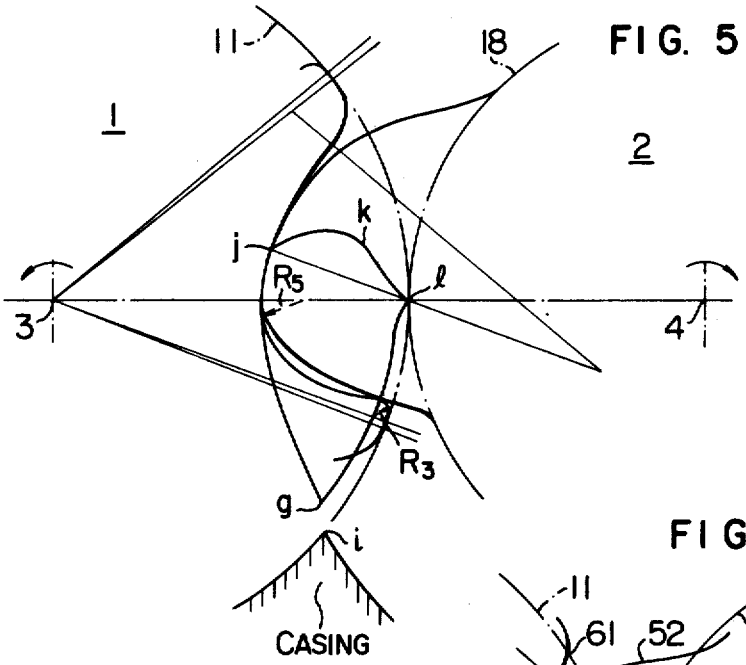

Namely, as shown in FIG. 5, the length of the locus of contact line between the first leading side flank 35 of the female rotor 1 and the male rotor 2 is represented as distance between points j and k, while the length of locus of contact line between the second leading side flank 39 and the male rotor 2 is given as the distance between points k and l.

A first trailing side flank 42 of the female rotor 1 is constituted by a portion extending between points 43 and 44 which are created by the arc of the teeth end flank of the male rotor 2. A second trailing side flank 45 of the female rotor 1, is constituted by a portion extending between points 44 and 46 formed by an arc of a radius $R_3$ and centered at a point 47. This radius $R_3$ is selected to be extremely small as compared with the aforementioned radius $R_2$ but not so small as to spoil the life or durability of the edge of hobbing tool. The ratio of radius between $R_2$ and $R_3$ is selected to fall within the range specified below, taking into account both of the tool life of the hobbing tool and the area of the blow hole.

$$0.15 \leqq R_3/R_2 \leqq 0.45$$

Namely, the lower limit of the ratio is determined by the area of the blow hole, while the upper limit is determined by the tool life. By generating the first trailing side flank 42 by an arc, the portion to be generated by points is eliminated so that the sealing effect becomes less sensitive to the precision of shape, resulting in an improved sealing effect and, accordingly, improved performance.

Furthermore, since the radius $R_3$ of the arc constituting the second trailing flank 45 is selected to be extremely small as compared with the aforementioned radius $R_2$, the gap between points g and i, which is formed when the meshing between the point 44 of the female rotor 1 and the trailing side teeth end flank of the male rotor 2 coincides at the point g, is much reduced as compared with the conventional case as will be seen from FIG. 5. Therefore, a remarkable improvement of the performance is achieved.

Leading side teeth bottom flank 48 interconnects the first leading side flank 35 of the female rotor 1 and the first trailing side flank 42 of the female rotor 1. The portion between points 37 and 43 of the leading side teeth bottom flange 48 is formed by an arc of a radius $R_4$ and centered at or in a vicinity of the point of intersection 21.

Figure 6:
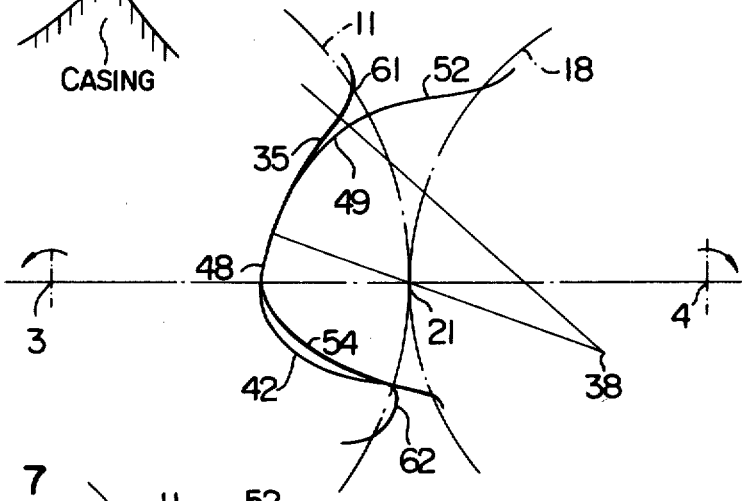
FIGS. 6 and 7 are side views, on an enlarged scale, of a portion of rotors of screw rotor assemblies constructed in accordance with different embodiments of the invention, each taken at a plane perpendicular to the axes of the rotors.

As shown in FIG. 6, the male rotor 2 includes a first leading side flank 49 extending between points 50 and 51 which are generated by the arc of the first leading side flank 35 of the female rotor 1 (points 36 to 37). A second leading side flank 52 extends over points 51 and 53 which are generated by the arc (points 36 to 40) of the second leading side flank 39 of the female rotor 1. A first trailing side flank 54 extends over points 55 and 56 generated by the arc (points 44 to 46) of the second trailing side flank 45 of the female rotor 1. A leading side teeth end flank 57 extends over points 50 and 58 formed, as in the case of the leading side teeth bottom flank 48, by an arc of a radius $R_4$ and centered at or in a vicinity of the point of intersection 21. A trailing side teeth end flank 59 generates the first trailing side flank 42 of the female rotor 1, and extends over points 55 and 58 formed by an arc of a radius $R_5$ and centered at a point 60 on a line interconnecting the centers 3, 4 of rotation of both rotors 1, 2.

Reference numerals 3' and 4' are the points of the outer periphery of the female rotor 1 and the teeth bottom of the male rotor 2, respectively.

The outer periphery of the female rotor 1 and the teeth bottom of the male rotor 2 are formed by the arcs provided by the radii of pitch circle 11, 18 and centered at the centers 3, 4 of both rotors 1, 2.

Figure 7:
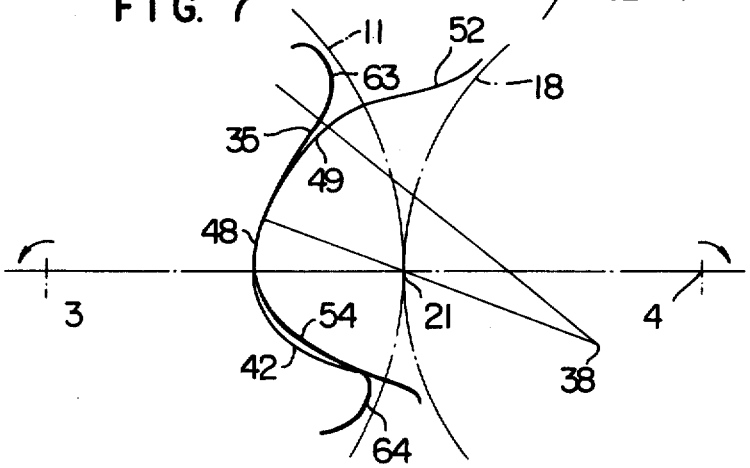

FIGS. 6 and 7 differ from the embodiment shown in FIG. 3 in that the second leading side flanks 61, 63 and second trailing side flanks 62, 64, which are formed by arcs of radii $R_2$, $R_3$ centered at a point inside the pitch circle 11 of the female rotor 1, are disposed at the outside or inside of the pitch circle 11, as illustrated. By arranging the second leading side flank and the second trailing side flank in this manner, it is possible to select any desired teeth shape coefficient.

As has been described, according to the invention, the first and second leading side flanks constituting the leading side flank of the female rotor are formed by arcs of large radii $R_1$, $R_2$, so that the hobbing is facilitated and, at the same time, the fabrication of hobbing tool having a high precision of the tool edge is also facilitated. In addition, the life of the hobbing tool is remarkably prolonged and the wear of both rotors is considerably reduced.

It is also to be pointed out that, since the first and second trailing side flanks constituting the trailing side flank of the female rotor 1 are formed by the arc generated by the arc of the end of the male rotor having a radius $R_5$ and an arc of a radius $R_3$ which is smaller than the radius $R_2$ of the second leading side flank, the area of the blow hole is largely reduced to achieve a remarkable improvement of performance.

In the described embodiment, the female and male rotors have five and six teeth, respectively. These number of teeth, however, are not exclusive.

What is claimed is:

1. An oil-cooled type screw rotor assembly having a female rotor and a male rotor adapted to rotate around parallel axes in meshing condition, wherein a leading side flank, as viewed in a normal direction of rotation, of said female rotor includes a first leading side flank formed by an arc of a radius $R_1$ centered at a point outside of a pitch circle of said female rotor and a second leading side flank formed by an arc of a radius $R_2$ centered at a point within said pitch circle, a trailing side flank of said female rotor includes a first trailing said flank generated by an arc of teeth end of said male rotor having a radius $R_5$ centered at a point on a line interconnecting centers of rotations of said rotors and a second trailing side flank formed by an arc of a radius $R_3$ smaller than the radius $R_2$ of said second leading side flank of said female rotor centered at a point within said pitch circle, and wherein a tooth contour of teeth of said male rotor is substantially generated by the arcs of said leading side flanks and trailing side flanks of said female rotor.

2. A screw rotor assembly as claimed in claim 1, wherein a driving power is transmitted between said first leading side flanks of said female rotor and said male rotor.

3. A screw rotor assembly as claimed in claim 1, wherein a ratio of the radius $R_3$ of the arc forming said second trailing side flank to the radius $R_2$ of the arc forming said second leading side flank of said female rotor is is determined accordance with the following relationship:

$$0.15 \leqq R_3/R_2 \leqq 0.45.$$

4. A screw rotor assembly as claimed in claim 1, wherein a leading side tooth bottom flank formed between said leading side flank and trailing side flank of said female rotor is formed by an arc of a radius $R_4$ centered at the point of intersection of the pitch circles of the male and female rotors.

5. A screw rotor assembly as claimed in claim 4, wherein said leading side flank, leading side tooth bottom flank, and trailing side flank of said female rotor are smoothly connected.

6. A screw rotor assembly as claimed in claim 4, wherein said first leading side flank of said female rotor is formed by an arc of a radius $R_1$ and centered at a point located on the extension of a line interconnecting one end point of said leading side tooth bottom flank formed by the arc of radius $R_4$ and the point of intersection of said pitch circles of the male and female rotors.

7. A screw rotor assembly as claimed in claim 4 or 6, wherein the radius $R_1$ of said first leading side flank of said female rotor is selected to be 1.3 to 2.5 times as large as the radius $R_4$ of the leading side teeth bottom flank of the same.

8. A screw rotor assembly as claimed in claim 1, wherein an outer periphery of said female rotor and a tooth bottom of said male rotor are formed by arcs centered at respective rotor axes.

9. A screw rotor assembly as claimed in claim 1, wherein an outermost portion of said second leading side flank and an outermost portion of said second trailing side flank are disposed outside said pitch circle of said female rotor.

10. A screw rotor assembly as claimed in claim 1, wherein an outermost portion of said second leading side flank and an outermost portion of said second trailing side flank are disposed in said pitch circle of said female rotor.

11. A screw rotor assembly as claimed in claim 1, wherein the outermost portion of said second leading side flank and the outermost portion of said second trailing side flank are disposed on said pitch circle of said female rotor.

* * * * *